US007985444B2

(12) United States Patent
Quist et al.

(10) Patent No.: US 7,985,444 B2
(45) Date of Patent: Jul. 26, 2011

(54) PROCESS FOR THE MANUFACTURING OF DECORATIVE BOARDS

(75) Inventors: Magnus Quist, Trelleborg (SE); Peter Miller, Trelleborg (SE); Jan Ericsson, Helsingborg (SE)

(73) Assignee: Pergo AG, Baar (CH)

( * ) Notice: Subject to any disclaimer, the term of this patent is extended or adjusted under 35 U.S.C. 154(b) by 818 days.

(21) Appl. No.: 10/471,865

(22) PCT Filed: Mar. 13, 2002 (Under 37 CFR 1.47)

(86) PCT No.: PCT/SE02/00453

§ 371 (c)(1), (2), (4) Date: Apr. 30, 2004

(87) PCT Pub. No.: WO02/072367

PCT Pub. Date: Sep. 19, 2002

(65) Prior Publication Data

US 2005/0003099 A1 Jan. 6, 2005

(30) Foreign Application Priority Data

Mar. 14, 2001 (SE) ..... 0100860

(51) Int. Cl.
*B05D 7/06* (2006.01)
*B05D 3/06* (2006.01)

(52) U.S. Cl. ..... 427/202; 427/204; 427/205; 427/325; 427/558

(58) Field of Classification Search ..... 427/551, 427/558, 475–485, 325, 202–205, 277–278, 427/553

See application file for complete search history.

(56) References Cited

U.S. PATENT DOCUMENTS

| | | | | |
|---|---|---|---|---|
| 3,208,901 | A | 9/1965 | Kelley et al. | |
| 3,247,047 | A * | 4/1966 | Buckley | 428/151 |
| 3,904,791 | A * | 9/1975 | Iverson et al. | 427/277 |
| 3,996,154 | A | 12/1976 | Johnson et al. | |
| 4,113,894 | A | 9/1978 | Koch, II | |
| 4,122,225 | A | 10/1978 | Holmstrom et al. | |
| 4,759,955 | A | 7/1988 | Hsu et al. | |
| 5,075,057 | A | 12/1991 | Hoedl | |
| 5,348,778 | A | 9/1994 | Knipp et al. | |
| 5,571,323 | A * | 11/1996 | Duffy et al. | 118/308 |
| 5,824,373 | A * | 10/1998 | Biller et al. | 427/474 |
| 5,993,915 | A * | 11/1999 | Krebsbach | 427/452 |
| 6,006,486 | A * | 12/1999 | Moriau et al. | 52/589.1 |
| 6,017,640 | A | 1/2000 | Muthiah et al. | |
| 6,093,473 | A | 7/2000 | Min | |
| 6,093,481 | A | 7/2000 | Lynn et al. | |
| 6,100,316 | A | 8/2000 | Lobert | |
| 6,101,778 | A * | 8/2000 | Mårtensson | 52/582.1 |
| 6,106,654 | A | 8/2000 | Velin et al. | |
| 6,136,370 | A | 10/2000 | Muthiah et al. | |
| 6,291,078 | B1 * | 9/2001 | Chen et al. | 428/543 |
| 6,421,970 | B1 | 7/2002 | Martensson et al. | |
| 6,588,166 | B2 | 7/2003 | Martensson et al. | |
| 6,685,993 | B1 * | 2/2004 | Hansson et al. | 427/551 |

FOREIGN PATENT DOCUMENTS

| | | |
|---|---|---|
| DE | 36 30 315 | 3/1988 |
| GB | 2324982 | 11/1998 |
| WO | WO 98/29265 | 7/1998 |
| WO | WO 98/50207 | 11/1998 |

OTHER PUBLICATIONS

Libert, Nicholas, "Powder Coating: The Complete Finishers Handbook", pp. 99-100, 1994.*

Swedish Publication No. 9904781-3, published Jun. 24, 2001.

* cited by examiner

*Primary Examiner* — Frederick J Parker

(74) *Attorney, Agent, or Firm* — Novak Druce + Quigg LLP

(57) ABSTRACT

A process of the manufacturing of decorative boards with an abrasion resistant surface and edges with joining functionality. This process includes the steps of a) cutting a carrier board to the desired dimension and molding edges with joining functionality, b) treating at least the upper surface of the board, c) applying radiation curable dry acrylic lacquer powder by means of electrostatic spray nozzles, d) heating the acrylic lacquer so that it melts, and e) curing the acrylic lacquer by UV- or electron beam radiation.

38 Claims, No Drawings

PROCESS FOR THE MANUFACTURING OF DECORATIVE BOARDS

CROSS-REFERENCE TO RELATED APPLICATIONS

This application is a §371 Application of International Application No. PCT/SE02/00453, filed on Mar. 13, 2002, claiming the priority of Swedish Application No. 0100860-6, filed Mar. 14, 2001, the entire disclosures of which are incorporated herein by reference in their entireties.

BACKGROUND OF THE INVENTION

1. Field of the invention

The present invention relates to a process for the manufacturing of decorative boards with a decorative upper surface.

2. Background of the Invention

Products clad with thermosetting laminate is common in many areas nowadays. They are mostly used where the demands on abrasion resistance are high, and furthermore where resistance to different chemicals and moisture is desired. As examples of such products floors, floor skirtings, table tops, work tops and wall panels can be mentioned.

The thermosetting laminate most often consist of a number of base sheets with a decor sheet placed closest to the surface. The decor sheet can be provided with a pattern by desire. Common patterns usually visualize different kinds of wood or mineral such as marble and granite. Also fantasy based decor and monochrome decor are rather common.

When manufacturing laminate boards comprising thermosetting laminate the process normally includes the steps; printing decor on a paper of α-cellulose, impregnating the decorative paper with melamine-formaldehyde resin, drying the decorative paper, laminating the decorative paper under heat and pressure together with similarly treated supporting papers, applying the decorative laminate on a carrier and finally sawing and milling the carrier to the desired format. All these steps in the manufacturing are very time consuming and will cause waste of the thermosetting laminate. The thermosetting laminate is a rather costly part of a laminate floor.

Another problem with thicker laminates with a core of particle board or fiber board is that these normally will absorb a large amount of moisture, which will cause them to expand and soften whereby the laminate will warp. The surface layer might even, partly or completely come off in extreme cases since the core will expand more than the surface layer. This type of laminate can therefore not be used in humid areas, such as bath rooms or kitchens, without problem.

The problems can be partly solved by making the core of paper impregnated with thermosetting resin as well. Such a laminate is most often called compact laminate. These compact laminates are, however, very expensive and laborious to obtain as several tens of layers of paper have to be impregnated, dried and put in layers.

BRIEF SUMMARY OF THE INVENTION

The above mentioned problems have, through the present invention been solved and a rational process for manufacturing moisture resistant decorative boards is achieved. The invention relates to a process for the manufacturing of decorative boards with an abrasion resistant surface and edges with joining functionality. The process comprises the steps;

a) Cutting a carrier board to the desired dimension and molding edges with joining functionality.
b) Treating at least the upper surface of the board.

c) Applying radiation curable dry acrylic lacquer powder by means of electrostatic spray nozzles.
d) Heating the acrylic lacquer so that it melts.
e) Curing the acrylic lacquer by means of radiation, the radiation being selected from the group consisting of UV-radiation and electron beam radiation.

It is, due to the method of lacquer application, possible to utilize boards with a structured surface. This structure can be achieved at any stage before cutting the board to the desired dimension or during treating of the upper surface of the board. Such a structure on the board is suitably rather rough as the lacquer will tend to level the surface. This implies that structure depth should be at least 0.5 mm.

The upper surface of the board can according to one embodiment of the invention be pressed with a heated calendar roller. The surface temperature of the calendar roller is suitably in the range 45-150° C. The calendar roller preferably exerts a pressure on the board in the range 10-100 bar. The calendar roller may be provided with either a plane surface, whereby the surface of the board will be plane, or a structured surface in order to achieve a surface structure on the board. It is advantageous to utilize two rollers where one is plane and the other one structured in cases where the surface of the board is to be structured by means of rollers as described above. The calendar pressing of the board will increase the surface density as well as leveling the micro structure of the surface and is an alternative to sanding. Sanding may also show impractical on structured surfaces. On plane surfaces or on boards with selected surface structures the board surface can be sanded smooth before applying the acrylic lacquer.

The preparations may also, or alternatively, include a primer applied on the board before applying the acrylic lacquer.

DETAILED DESCRIPTION OF THE INVENTION

A board manufactured according to the present invention may be formed by cutting a carrier board to the desired dimension and molding edges with joining functionality, and be provided with several types of decor which are applied in different manners. According to one embodiment of the invention a decorative foil is applied on the board before applying the acrylic lacquer. According to one alternative embodiment a decor is printed on the upper surface before applying the acrylic lacquer. The two above mentioned methods of applying decor are well suited for more complex decor containing several colors like for example when simulating wood like pine, birch and mahogany or when simulating minerals like marble and sandstone. These methods of applying decor are of course flexible and also be used for applying decor which is fantasy based or even monochrome.

In some cases, as for example on boards intended for use on floors where a very high degree of abrasion resistance is desirable, an intermediate stage of adding extra abrasion resistance is added to the process according to one embodiment of the invention. This extra abrasion resistance is applied before applying the acrylic lacquer. Extra abrasion resistance will be needed in extreme cases of abrasion as for example on floors in public environments like hotel lobbies or the like.

According to one embodiment of the invention the upper surface of the board is coated with a bonding layer to an amount of 10-40 g/m$^2$. Hard particles with an average particle size in the range 40-150 μm are then sprinkled to an amount of 1-30 g/m$^2$ on the sticky bonding layer. The hard particles are selected from the group consisting of aluminum oxide, silicon oxide, silicon carbide and mixtures thereof. The bonding layer is suitably a wet UV-curable acrylic lacquer, which bonding layer is cured after having applied the hard particles. The bonding layer may also be a dry UV- or electron beam curable acrylic lacquer which is melted before applying the hard particles.

According to one embodiment of the invention the board is preheated before applying the acrylic lacquer. This will shorten the time period for the melting process. The preheating is suitably arranged so that the surface temperature of the board is in the range 40-150° C. when the application of acrylic lacquer is initiated. The preheating is alternatively arranged so that the core temperature of the board is in the range 40-150° C. when the application of acrylic lacquer is initiated.

The acrylic lacquer is preferably applied to an amount of 10-250 g/m$^2$. Since abrasion will be higher on the upper side of the board the acrylic lacquer is suitably applied to an amount of 50-250 g/m$^2$ on the upper surface of the board, while it sufficient to apply the acrylic lacquer to an amount of 10-70 g/m$^2$ on the lower surface of the board. The acrylic lacquer is suitably applied to an amount of 10-100 g/m$^2$ on the edges of the board. The amount of lacquer to be applied on the edges is taken into consideration when molding of the edges.

In order to increase the abrasion resistance the acrylic lacquer applied on the upper surface preferably comprises hard particles selected from the group consisting of, aluminum oxide, silicon oxide and silicon carbide. The hard particles preferably have an average particle size in the range 1-150 μm, suitably an average particle size in the range 1-50 μm. The particles may be premixed with the acrylic lacquer prior to the application. According to one embodiment of the invention the hard particles are mixed with the acrylic lacquer in the nozzles during the coating process. This will make it possible to easily adjust the amount of particles on the surface giving great flexibility to the process.

The acrylic lacquer is applied by separate groups of nozzles, the groups comprising an upper surface coating group, a rear surface coating group and at least one edge coating group. According to one embodiment of the invention the number of edge coating groups are two. According to another embodiment of the invention the number of edge coating groups are four.

In certain embodiments of the invention the edges are provided with joining functionality comprising snap-action interlocking. Such joint will most often have a rather complicated cross-section in which surfaces are facing away from a reasonable position of a lacquer application nozzle. In order to ensure that an even distribution of lacquer is achieved the acrylic lacquer applied on the edges is preferably guided by means of an air stream, the air stream being achieved by means of a narrow air evacuation tube, the air evacuation tube having a suction nozzle which is arranged adjacent to recesses and pockets molded in the edge whereby a more uniform coating is achieved on the edge.

The dry acrylic lacquer will have to be melted before curing. According to one embodiment of the invention the acrylic lacquer is melted by means of hot air environment. According to another embodiment of the invention the acrylic lacquer is melted by means of infrared radiation. In certain embodiments of the invention the edges are provided with joining functionality comprising snap-action interlocking. Such joint will most often have a rather complicated cross-section in which surfaces are facing away from a reasonable position of an infrared radiator. In order to ensure that the lacquer is evenly melted the acrylic lacquer applied on the edges is illuminated with the infrared radiation via reflectors. These reflectors can be made be small enough to be placed inside a groove.

In embodiments where the molten acrylic lacquer is cured by means of UV radiation, the acrylic lacquer applied on the edges are suitably illuminated with UV light via reflectors in manners similar to the melting process described above.

The invention is described further in connection to process schemes below.

Process scheme 1

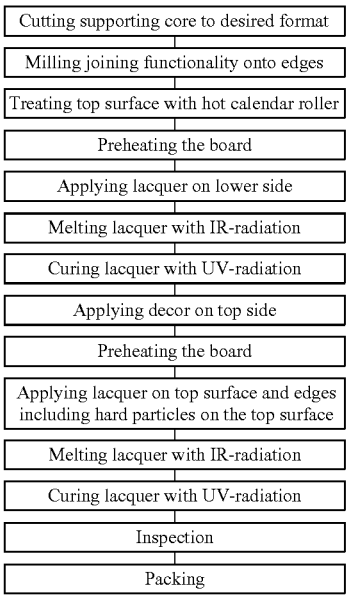

A supporting core is cut to the desired board format and is provided with an upper side, a lower side and edges provided with joining functionality, such as tongue and groove.

The side intended to become the upper side of the board is then pressed with a hot calendar roller. The surface temperature of the calendar roller is 60° C. while the pressure is 60 bar.

The board is then arranged so that the side intended as the lower side is facing upwards. The board is then heated whereby a wear layer of UV-curing dry acrylic lacquer powder is applied on the lower side, now facing upwards, by means of a group of electrostatic spray nozzles to an amount of 50 g/m$^2$. The acrylic powder applied is then heated to a temperature of 100° C. by means of IR radiation so that it melts whereby the melted acrylic layer is cured by means of UV-radiation so that it cures. The board is then turned so that the side intended as the upper side of the finished board is facing upwards. A decor is then applied on the upper side by means of a digital photo-static printer. The decor is positioned from a predetermined fixing point in form of a corner of the supporting core, while the decor direction is aligned with the long side edge initiating from the same corner.

The decorated board is then heated whereby a wear layer of UV-curing dry acrylic lacquer powder is applied by means of a group of electrostatic spray nozzles to an amount of 170 g/m$^2$. Hard particles of aluminum oxide with an average particle size of 30 μm to an amount of 10 g/m$^2$ is added through a separate nozzle within the spray nozzles so that they become evenly distributed within the wear layer of the upper side. The edges are coated with UV-curing dry acrylic lacquer by means of separate group of electrostatic edge coating nozzles to an amount of 80 g/m$^2$. The acrylic powder applied is then heated to a temperature of 105° C. by means of IR-radiation so that it melts whereby the melted acrylic layer is cured by means of UV-radiation so that it cures. Reflectors are used to illuminate hidden corners of the profiles on the edges with both IR- and UV-radiation when required. The boards are after cooling ready final inspection and packing.

Process scheme 2

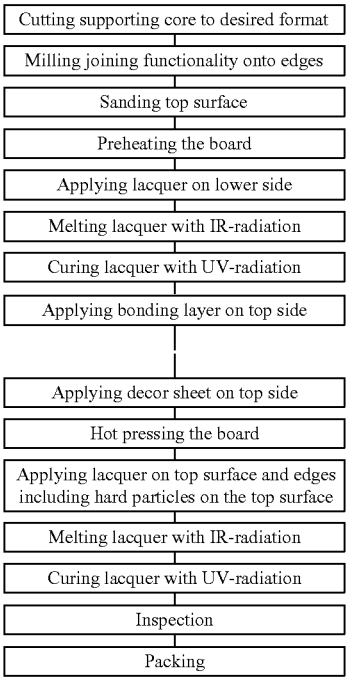

A supporting core is cut to the desired board format and is provided with an upper side, a lower side and edges provided with joining functionality, such as tongue and groove.

The side intended to become the upper side of the board is then sanded smooth.

The board is then arranged so that the side intended as the lower side is facing upwards. The board is then heated whereby a wear layer of UV-curing dry acrylic lacquer powder is applied on the lower side, now facing upwards, by means of a group of electrostatic spray nozzles to an amount of 70 g/m$^2$. The acrylic powder applied is then heated to a temperature of 105° C. by means of IR-radiation so that it melts whereby the melted acrylic layer is cured by means of UV-radiation so that it cures. The board is then turned so that the side intended as the upper side of the finished board is facing upwards. A decor sheet is then applied on the upper side after having applied a bonding layer. The decor sheet may be constituted of paper impregnated with for example acrylic resin or melamine formaldehyde resin. The decor sheet may alternatively be constituted of a polymeric foil.

The decorated board is then heated whereby a wear layer of UV-curing dry acrylic lacquer powder is applied by means of a group of electrostatic spray nozzles to an amount of 200 g/m$^2$. Hard particles of aluminum oxide with an average particle size of 30 μm to an amount of 12 g/m$^2$ is added through a separate nozzle within the spray nozzles so that they become evenly distributed within the wear layer of the upper side. The edges are coated with UV-curing dry acrylic lacquer by means of separate group of electrostatic edge coating nozzles to an amount of 80 g/m$^2$. The acrylic powder applied is then heated to a temperature of 105° C. by means of IR-radiation so that it melts whereby the melted acrylic layer is cured by means of UV-radiation so that it cures. Reflectors are used to illuminate hidden corners of the profiles on the edges with both IR- and UV-radiation when required. The boards are after cooling ready final inspection and packing.

Process scheme 3

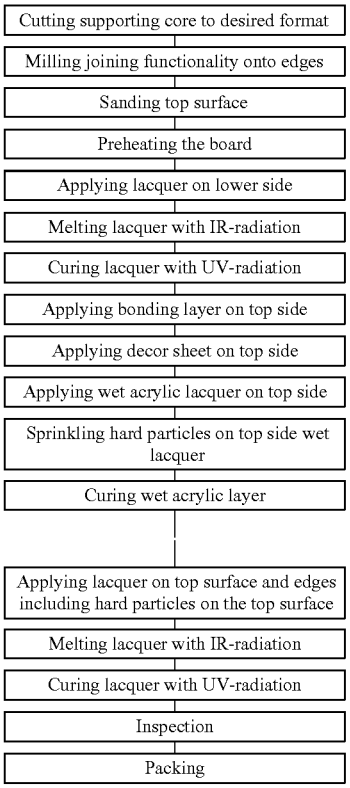

A supporting core is cut to the desired board format and is provided with an upper side, a lower side and edges provided with joining functionality, such as tongue and groove.

The side intended to become the upper side of the board is then sanded smooth.

The board is then arranged so that the side intended as the lower side is facing upwards. The board is then heated whereby a wear layer of UV-curing dry acrylic lacquer powder is applied on the lower side, now facing upwards, by means of a group of electrostatic spray nozzles to an amount of 70 g/m$^2$. The acrylic powder applied is then heated to a temperature of 100° C. by means of IR-radiation so that it melts whereby the melted acrylic layer is cured by means of UV-radiation so that it cures. The board is then turned so that the side intended as the upper side of the finished board is facing upwards. A decor sheet is then applied on the upper side after having applied a bonding layer. The decor sheet may be constituted of paper impregnated with for example acrylic resin or melamine formaldehyde resin. The decor sheet may alternatively be constituted of a polymeric foil.

A layer of wet UV-curable acrylic lacquer is then applied on top of the decor sheet by means of roller coating to a lacquer amount of 30 g/m$^2$. 10 g/m$^2$ of hard particles of aluminum oxide with an average particle size of 100 μm is then sprinkled on the still wet layer of lacquer whereupon the lacquer is cured by means of UV-radiation.

The board is then heated whereby a wear layer of UV-curing dry acrylic lacquer powder is applied by means of a group of electrostatic spray nozzles to an amount of 180 g/m$^2$. Hard particles of aluminum oxide with an average particle size of 30 μm to an amount of 11 g/m$^2$ is added through a separate nozzle within the spray nozzles so that they become evenly distributed within the wear layer of the upper side. The edges are coated with UV-curing dry acrylic lacquer by means of separate group of electrostatic edge coating nozzles to an amount of 80 g/m$^2$. The acrylic powder applied is then heated to a temperature of 100° C. by means of IR-radiation so that it melts whereby the melted acrylic layer is cured by means of UV-radiation so that it cures. Reflectors are used to illuminate hidden corners of the profiles on the edges with both IR- and UV-radiation when required. The boards are after cooling ready final inspection and packing.

Process scheme 4

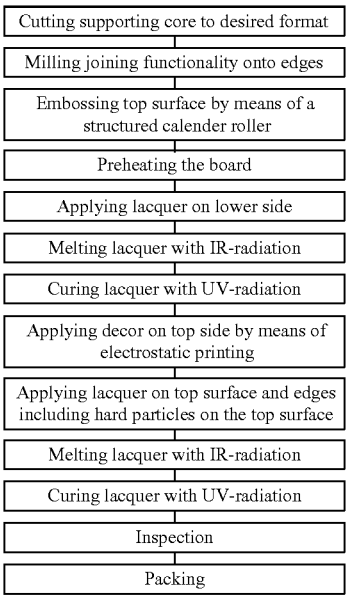

A supporting core is cut to the desired board format and is provided with an upper side, a lower side and edges provided with joining functionality, such as tongue and groove.

The side intended to become the upper side of the board is then embossed by pressing a heated structured calendar roller towards the upper surface. The surface temperature of the calendar roller is 60° C. while the pressure is 60 bar.

The board is then arranged so that the side intended as the lower side is facing upwards. The board is then heated whereby a wear layer of UV-curing dry acrylic lacquer powder is applied on the lower side, now facing upwards, by means of a group of electrostatic spray nozzles to an amount of 70 g/m$^2$. The acrylic powder applied is then heated to a temperature of 105° C. by means of IR-radiation so that it melts whereby the melted acrylic layer is cured by means of UV-radiation so that it cures. The board is then turned so that the side intended as the upper side of the finished board is facing upwards. A decor is then printed on the upper side by means of an electrostatic printer.

The decorated board is then heated whereby a wear layer of UV-curing dry acrylic lacquer powder is applied by means of a group of electrostatic spray nozzles to an amount of 200 g/m$^2$. Hard particles of aluminum oxide with an average particle size of 30 μm to an amount of 12 g/m$^2$ is added through a separate nozzle within the spray nozzles so that they become evenly distributed within the wear layer of the upper side. The edges are coated with UV-curing dry acrylic lacquer by means of separate group of electrostatic edge coating nozzles to an amount of 80 g/m$^2$. The acrylic powder applied is then heated to a temperature of 105° C. by means of IR-radiation so that it melts whereby the melted acrylic layer is cured by means of UV-radiation so that it cures. Reflectors are used to illuminate hidden corners of the profiles on the edges with both IR- and UV-radiation when required. The boards are after cooling ready final inspection and packing.

Process scheme 5

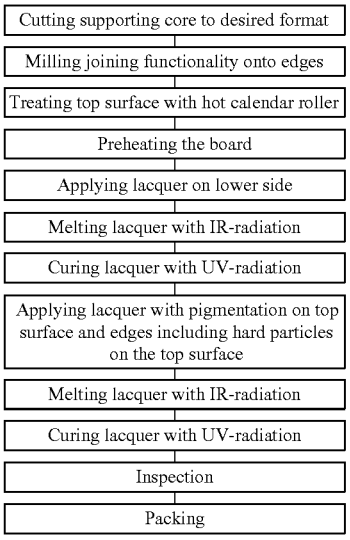

A supporting core is cut to the desired board format and is provided with an upper side, a lower side and edges provided with joining functionality, such as tongue and groove.

The side intended to become the upper side of the board is treated with a hot calendar roller. The surface temperature of the calendar roller is 60° C. while the pressure is 60 bar.

The board is then arranged so that the side intended as the lower side is facing upwards. The board is then heated whereby a wear layer of UV-curing dry acrylic lacquer powder is applied on the lower side, now facing upwards, by means of a group of electrostatic spray nozzles to an amount of 70 g/m$^2$. The acrylic powder applied is then heated to a temperature of 105° C. by means of IR-radiation so that it melts whereby the melted acrylic layer is cured by means of UV-radiation so that it cures. The board is then turned so that the side intended as the upper side of the finished board is facing upwards.

The board is then heated whereby a wear layer of UV-curing dry acrylic lacquer powder with comprising color pigments is applied by means of a group of electrostatic spray nozzles to an amount of 200 g/m$^2$. Hard particles of aluminum oxide with an average particle size of 30 μm to an amount of 12 g/m$^2$ is added through a separate nozzle within the spray nozzles so that they become evenly distributed within the wear layer of the upper side. The edges are coated with UV-curing dry acrylic lacquer by means of separate group of electrostatic edge coating nozzles to an amount of 80 g/m$^2$.

The acrylic powder applied is then heated to a temperature of 105° C. by means of IR-radiation so that it melts whereby the melted acrylic layer is cured by means of UV-radiation so that it cures. Reflectors are used to illuminate hidden corners of the profiles on the edges with both IR- and UV-radiation when required. The boards are after cooling ready final inspection and packing.

We claim:

1. A process for the manufacturing of decorative boards with an upper lacquered covered surface; and edges with joining functionality, the process comprising the steps:

a) in a first step, cutting a carrier board having an upper surface to the desired dimension and making edges on the carrier board with at least one joining element, the upper surface of the carrier board being devoid of any lacquer prior to the steps of cutting and making edges, whereby the steps of cutting and making edges do not remove any lacquer from the upper surface of the carrier board, thereafter b) applying radiation curable dry acrylic lacquer powder to at least the upper surface of the carrier board and optionally applying radiation curable dry lacquer to the edges of the carrier board, c) heating the dry acrylic lacquer powder so that it melts, d) curing the acrylic lacquer by means of radiation, the radiation being selected from the group consisting of UV-radiation and electron beam radiation ; and, e) obtaining a decorative board with an upper surface of lacquer.

2. A process according to claim 1, further comprising sanding at least the upper surface of the carrier board before the step of applying the acrylic lacquer.

3. A process according to claim 1, further comprising pressing at least the upper surface of the carrier board with a heated calendar roller, the surface temperature of the calendar roller being in the range 45-150° C. and exerting pressure with the calendar roller on the carrier board in the range 10-100 bar before applying the acrylic lacquer.

4. A process according to claim 1, further comprising applying a primer on at least the upper surface of the carrier board before the step of applying the acrylic lacquer.

5. A process according to claim 1, further comprising applying a decorative foil on the upper surface of the carrier board before applying the acrylic lacquer.

6. A process according to claim 1, further comprising printing a decor directly on the upper surface of the carrier board before applying the acrylic lacquer.

7. A process according to claim 1, wherein the heating of the acrylic lacquer of the carrier board forms a bonding layer to an amount of 10-40 g/m$^2$, sprinkling particles with an average particle size in the range 40-150 μm in an amount of 1-30 g/m$^2$ on the bonding layer, the particles are selected from the group consisting of aluminum oxide, silicon oxide, silicon carbide and mixtures thereof.

8. A process according to claim 7, wherein the bonding layer is a wet UV-curable acrylic lacquer, the process further comprising applying the particles to the wet lacquer and thereafter curing the lacquer.

9. A process according to claim 7, wherein the bonding layer is a UV- or electron beam curable acrylic lacquer.

10. A process according to claim 1, further comprising preheating the carrier board before applying the acrylic lacquer.

11. A process according to claim 10, wherein the preheating is arranged so that a surface temperature of the board is in the range 40-150° C. when the application of the dry acrylic lacquer powder is initiated.

12. A process according to claim 10, wherein the preheating is arranged so that a core temperature of the carrier board is in the range 40-150° C. when the application of acrylic lacquer is initiated.

13. A process according to claim 1, wherein the acrylic lacquer is applied to an amount of 10-250 g/m$^2$.

14. A process according to claim 13, wherein the acrylic lacquer is applied to an amount of 50-250 g/m$^2$ on the upper surface of the carrier board.

15. A process according to claim 13, wherein the acrylic lacquer is also applied to an amount of 10-70 g/m$^2$ on a lower surface of the carrier board.

16. A process according to claim 13, wherein the acrylic lacquer is also applied to an amount of 10-100 g/m$^2$ on the edges of the carrier board.

17. A process according to claim 13, wherein the acrylic lacquer applied on the upper surface of the carrier board further comprises particles selected from the group consisting of aluminum oxide, silicon oxide and silicon carbide.

18. A process according to claim 17, wherein the particles have an average particle size in the range 1-150 μm.

19. A process according to claim 17, wherein the particles have an average particle size in the range 1-50 μm.

20. A process according to claim 13, wherein the acrylic lacquer is applied by separate groups of nozzles, the groups comprising an upper surface coating group, a rear surface coating group and at least one edge coating group.

21. A process according to claim 13, wherein the acrylic lacquer is applied by separate groups of nozzles, the groups comprising an upper surface coating group, a rear surface coating group and two edge coating groups.

22. A process according to claim 13, wherein the acrylic lacquer is applied by separate groups of nozzles, the groups comprising an upper surface coating group, a rear surface coating group and four edge coating groups.

23. A process according to claim 20, wherein the acrylic lacquer applied on the edges is guided by means of an air stream, the air stream being achieved by means of an air evacuation tube, the air evacuation tube having a suction nozzle which is arranged adjacent to recesses and pockets formed on the edge.

24. A process according to claim 13, wherein the acrylic lacquer is melted by means of hot air environment.

25. A process according to claim 13, wherein the acrylic lacquer is melted by means of infrared radiation.

26. A process according to claim 1, wherein the melted acrylic lacquer is cured by means of UV radiation, and that the acrylic lacquer applied on the edges are illuminated with UV light via reflectors.

27. A process according to claim 1, wherein said applying step also comprises achieving an even distribution of the lacquer on the edges.

28. A process according to claim 1, wherein the edges are also coated with the lacquer.

29. A process according to claim 1, wherein dry acrylic lacquer powder is also applied to the edges of the carrier board.

30. A process according to claim 1, wherein the dry acrylic lacquer powder is applied to the upper surface of the carrier board by means of electrostatic spray nozzles.

31. A process according to claim 1, further comprising treating at least the upper surface of the carrier board.

32. The process according to claim 1, further including the step of applying a digital photo-static printed decor to the upper surface of the carrier board prior to the step of applying radiation curable lacquer.

33. The process according to claim 1, wherein the step of making edges comprises milling the carrier board to form edges with at least one joining element.

34. The process according to claim 4, further including the step of printing a décor on the primer.

35. The process according to claim 1, further comprising embossing the upper surface of the carrier board before the step of applying the acrylic lacquer.

36. The process according to claim 35, further comprising the step of applying décor to the embossed upper surface of the carrier board by printing before the step of applying the acrylic lacquer.

37. A process according to claim 29, wherein the dry acrylic lacquer powder applied on the edges is illuminated with the infrared radiation via reflectors.

38. A process according to claim 30, wherein the particles are mixed with the acrylic lacquer in the nozzles during the coating process.

* * * * *